US005678494A

United States Patent [19]

Ulrich

[11] Patent Number: 5,678,494

[45] Date of Patent: Oct. 21, 1997

[54] BIOMASS-FUELED FURNACE

[76] Inventor: Gael Ulrich, 3 Ryan Way, Durham, N.H. 03824

[21] Appl. No.: 408,348

[22] Filed: Mar. 22, 1995

[51] Int. Cl.[6] ..... F23G 5/04

[52] U.S. Cl. ..... 110/224; 110/229; 110/251; 110/256; 110/257; 110/212; 110/302; 110/102

[58] Field of Search ..... 110/102, 118, 110/224, 251, 254, 256, 257, 302, 304, 229, 210–212

[56] References Cited

U.S. PATENT DOCUMENTS

| | | | |
|---|---|---|---|
| 3,926,582 | 12/1975 | Powell, Jr. et al. | 110/254 X |
| 4,378,208 | 3/1983 | Payne et al. | 432/14 |
| 4,470,358 | 9/1984 | Prochnow | 110/254 X |
| 4,543,890 | 10/1985 | Johnson | 110/102 |
| 4,616,572 | 10/1986 | Berthiller | 110/254 |
| 5,375,540 | 12/1994 | Verrecchia et al. | 110/257 |

*Primary Examiner*—Henry A. Bennett
*Assistant Examiner*—Susanne C. Tinker
*Attorney, Agent, or Firm*—William B. Ritchie

[57] ABSTRACT

A biomass-fueled furnace for residential or institutional space and hot water heating. Wood chips, the preferred fuel, are purchased "green and/or wet" and are stored in a dryer/storage assembly which uses waste clean exhaust gases produced by the furnace to dry them. Wood chips are fed via gravity to the primary combustion chamber where, via pyrolysis, they are burned. A thimble combustor eliminates radiant heat loss from the primary pyrolysis zone, allowing stable pyrolysis at low burning rates. A second combustion chamber fed with pre-heated air completely oxidizes pyrolysis gases. This furnace is capable of operating continuously at extremely low fuel consumption rates so that heat release can be regulated by thermostat in the same manner as conventional gas and oil fired furnaces. A combination of fuel drying plus secondary air preheating by the secondary flame allows stable operation at extremely low or "idle" fuel rates. This eliminates the need for ignition except when a new furnace is placed in service or following a maintenance shut-down. The furnace shifts from idle to active mode through an increase in primary air rate when more heat is called for. Chips flow by gravity to the primary combustor with no need for mechanical feeders or conveyors. Combustion rates and chip feed rates are regulated simply by the primary air rate. Secondary air rates are adjusted accordingly to promote clean, efficient operation.

15 Claims, 3 Drawing Sheets

BIOMASS-FUELED FURNACE

BACKGROUND OF THE INVENTION

1. Field of the Invention

The invention relates to combustion of biomass materials, such as wood chips, in a furnace suitable for use as a heat source in residential or commercial dwellings.

2. Description of the Related Art

Most people are troubled by utility costs, but few realize how fragile and uncertain is the underlying fuel supply. With less than a winter's supply of fuel on site, most citizens are hostages to a foreign-dominated market. This is especially true of rural Americans who depend on number 2 fuel oil that is derived largely from imported petroleum. Meanwhile, other clean fuels, lumbering and farming wastes, are left in nearby woods and fields to rot.

The use of biomass to heat space and water is not new. This most ancient of fuels is already used by many homeowners, but it is inconvenient to handle and if burned improperly, can pollute the air. Thus, its use is usually limited to comfort heating-as a supplement to other fuels.

In New England, wood chips are currently about one-half to one-third the price of oil per equivalent heating value. Here, where lumbering waste is left in the forest or chipped and sold for landscaping mulch, the potential supply exceeds any conceivable demand. A nationwide study by Battelle/Columbus Laboratories reported that wood residues discarded in 1980 contained energy equivalent to about half the total coal, residual (Number 6) fuel oil, distillate (Number 2) fuel oil, and natural gas consumed in the U.S. that year.

A device that will burn wood chips, farm waste, and other biomass as cheaply, cleanly, and conveniently as conventional furnaces burn fossil fuels has been sought for some time.

U.S. Pat. No. 4,559,882, issued to Dobson on Dec. 24, 1985, discloses a biomass-fueled furnace which claims to provide clean combustion at high temperatures with little excess air and at burn rates much lower than the best popular "air-tight" woodstoves. However, idle operation, analogous to a "pilot light" in a gas furnace where a small amount of fuel is continuously burning, is only made possible with complicated mechanical controls and manual attention.

U.S. Pat. No. 4,105,397, issued to Jasper et al. on Aug. 8, 1978, discloses a bark burning furnace that conveys green bark particles downward through a drying chamber that is fed countercurrently with hot combustion gases in a surrounding annular combustion zone. The green bark must be reduced to less than 35% moisture to burn in existing bark burners. In the Jasper device, the bark is dried and burned continuously. However, the particles must be smaller than 3/16" to dry appropriately. Fly ash is collected downstream. No provisions are made for idle operation. This device is intended for use as an energy source for a sawmill.

U.S. Pat. No. 4,312,278, issued to Smith et al. on Jan. 26, 1982, discloses a wood chip burning furnace that is meant for retrofitting conventional central heating oil furnaces. This device essentially substitutes a wood gun for an oil burner. The wood gun, itself, is basically a modified wood stove having forced air. An oil gun is used to ignite the wood gun. This design has no provision for drying the fuel or preheating primary and second combustion air. It is unsuitable for idle operation.

U.S. Pat. Nos. 4,378,208 and 4,334,484, issued to Payne et al. on Mar. 29, 1983 and Jun. 15, 1982, respectively, discloses a biomass gasifier combustor having a horizontal screw feeder tube that forces the biomass in a first combustor chamber. This device is a conventional gasifier-secondary combustor with auger feed that attempts "direct" grain drying. There is no provision for preheating the secondary air or drying the fuel to be burned. Even though wood chips are mentioned as a possible fuel, green or wet wood chips could not be used at low firing rates unless previously dried before being supplied to the Payne et al. furnace.

U.S. Pat. Nos. 4,395,956 and 4,334,484, issued to Hand et al. on Aug. 2, 1983 and Jun. 15, 1982, respectively, discloses another variation of a biomass furnace. This device utilizes a vertical orientation where fuel is gravity fed to the primary burning chamber. A hollow grate preheats secondary air with heat from the primary combustor. Firing rate is controlled by fuel feed rate. There is no provision for drying the fuel and, therefore, this device is unsuitable for idle operation without substantial modifications.

U.S. Pat. No. 4,471,702, issued to McKinlay et al. on Sep. 18, 1984 is another "wood gun" variant. This device is directed primarily to burn corn cobs. No device is provided that would permit green or wet wood chips to be burned in an idle operation nor does the device provide a means for preheating the secondary air.

U.S. Pat. No. 4,543,890, issued to Johnson et al. on Oct. 1, 1985), discloses a horizontal feed wood chip burning furnace. This apparatus lacks a fuel drying capacity and does not control the fuel rate with primary air.

U.S. Pat. No. 4,836,115, issued to MacArthur on Jun. 6, 1989, discloses a vertically oriented, gravity fed biomass furnace. This device stores the fuel to be burned in an upright cylindrical housing. There is no provision to dry the fuel before it is burned. Further, there is no provision for idle operation or to modulate the burning rate.

U.S. Pat. No. 4,987,840, issued to Honda on Jan. 29, 1991, discloses a vertically oriented feed incinerator. This device is directed to burning high-moisture, low heating value fuels. No preheating of the secondary air supply is provided. The device does not disclose a means for modulated control of the firing rate.

Cleanliness, convenience, compatibility, and cost are key to any design being readily acceptable for use as a residential or institutional furnace. Related to these key marketing factors are the technical constraints of combustion, known as the three T's: temperature, time and turbulence. Provided flexibility with the Three T's and given enough air, one can burn almost any fuel to completion. Under these circumstances, carbon and hydrogen, the major components of most fuels, oxidize to carbon dioxide and water as cleanly as the human body "burns" its food to these same substances. Pollution often results from ingredients in fuels that create other compounds. The formation of sulfur oxides by burning coal and oil is one prominent example. Pollution from chlorine in some fuels is another. Wood contains less than half the sulfur (on an energy-equivalent basis) than is found in domestic heating oil. Except for ash, there is no other intrinsic source of pollution from using wood as a fuel. Wood ash itself is valued as a soil conditioner and poses an environmental threat only when present in the atmosphere.

Cost is a powerful motive that inspires homeowners who own woodlots to use wood stoves. If one must purchase cordwood, however, the fuel price is not usually any lower than that of oil. The same can be said of wood pellets or corn that some are beginning to use for space heat. Wood chips, on the other hand, cost about one-half to one-third the price of number 2 fuel oil per equivalent heating value. Also, the price of wood chips has remained extremely stable for the last twenty years while that of other fuels has gyrated widely.

Sawdust and some other biomass fuels are even cheaper than wood chips, but the potential supply is not as great. The infrastructure of biomass fuel distribution is currently limited to large consumers like paper mills and wood-fired power plants, but distribution channels would evolve quickly with demand. Cutting, chipping, shipping, and storage of wood is a highly developed technology in the forest products industry.

Several major barriers exist that prevent widespread use of biomass as a domestic fuel. These problems, by and large, have not been solved by the above-referenced inventions. These include the work of hauling fuel, disposing of ashes, and lighting a fire whenever heat is required. Many homeowners object to storage which requires space that is sometimes unsightly. Most consumers would not sacrifice the convenience of a thermostat to control firing rate.

Any system that cannot be adapted to heat and hot water in existing buildings will not achieve widespread acceptance. Further, if a biomass furnace is so expensive that the savings in fuel costs is only a small fraction of the capital investment, most homeowners and building managers would not be interested.

Most of the above-cited references do not recognize these critical consumer acceptance factors. None of the them discusses all of factors, and, most importantly, no prior art devices meet the criteria in a cost effective manner.

SUMMARY OF THE INVENTION

It is an object of the invention to provide a biomass-fueled furnace that permits green or wet wood chips to be used as a fuel.

It is another object of the invention to provide a biomass-fueled furnace where the housing for the biomass fuel also serves as a dryer for the fuel.

It is still another object of the invention to provide a biomass-fueled furnace that has a vertically oriented, gravity fed fuel delivery system.

Another object of the invention is to provide a biomass-fueled furnace that has a thimble combustor.

It is another object of the invention to provide a biomass-fueled furnace that achieves gasification by utilizing two stage combustion.

It is another object of the invention to provide a biomass-fueled furnace that filters the primary combustion gases.

Another object of the invention is to provide a biomass-fueled furnace that pre-heats the secondary air from the secondary, final flame.

It is another object of the invention to provide a biomass-fueled furnace that controls fuel rate using primary air.

It is another object of the invention to provide a biomass-fueled furnace that achieves modulated control of the firing rate.

Finally, it is object of the invention to provide a biomass-fueled furnace that meets a homeowner's expectation of convenience, that is, will operate unattended with periodic ash removal accomplished by the fuel vendor; eliminates start-up or ignition problems by modulated firing rate so that start-up is necessary only when the furnace has been shut down for maintenance; fuel storage is attractive and also serves as the means for drying the fuel; and will function with high efficiency so that fuel savings will pay back the capital cost in a short period of time.

The invention is a biomass-fueled furnace for heating a structure having a heat demand. A two stage combustion section having a primary combustor and a secondary combustor is provided. A fuel storage section is connected to said primary combustor. The fuel storage section conveys the fuel to said primary combustor. A source of air for the primary combustor and a source of air for the secondary combustor is provided. The fuel is converted into pyrolysis gases within said primary combustor. Then, the pyrolysis gases are substantially oxidized to carbon dioxide gas and water vapor within said secondary combustor. A heat exchanger having an inlet connected to the source of air for the secondary combustor and an outlet connected to said secondary combustor is provided. The heat exchanger is associated with said secondary combustor. A portion of the heat produced into said secondary combustor is transferred through said heat exchanger to pre-heat the air for the secondary combustor.

A thimble is provided within said primary combustion section. The thimble has a three-dimensional substantially closed surface with an outside and an inside, with said surface having a plurality of openings and an outlet. The total surface area of said openings corresponds to the flow of air for said primary combustor. The size of said openings corresponds to the size of the fuel. The heat from the burning fuel adjacent to said thimble is substantially radiated back to said thimble and neighboring burning fuel. The ash produced in said primary combustor enters said openings in said surface of said thimble and exits from said outlet.

Blower means, connected to said primary source of air, is provided. The blower means provides a positive displacement-type of air flow. Controlling means for controlling said blower means in accordance with the heat demand is also provided. The rate of fuel being burned in said furnace corresponds to the flow of air to said primary combustor.

A first flue gas plenum having an inlet connected to said secondary combustor to receive flue gas that is emitted from said second secondary combustor is provided. The plenum has an outlet connected to a plurality of pipes positioned within said fuel storage section. The pipes are directly in contact with a portion of the fuel. The heat from the flue gas within said pipes assists drying the fuel.

DETAILED DESCRIPTION OF THE INVENTION

Figure 1:
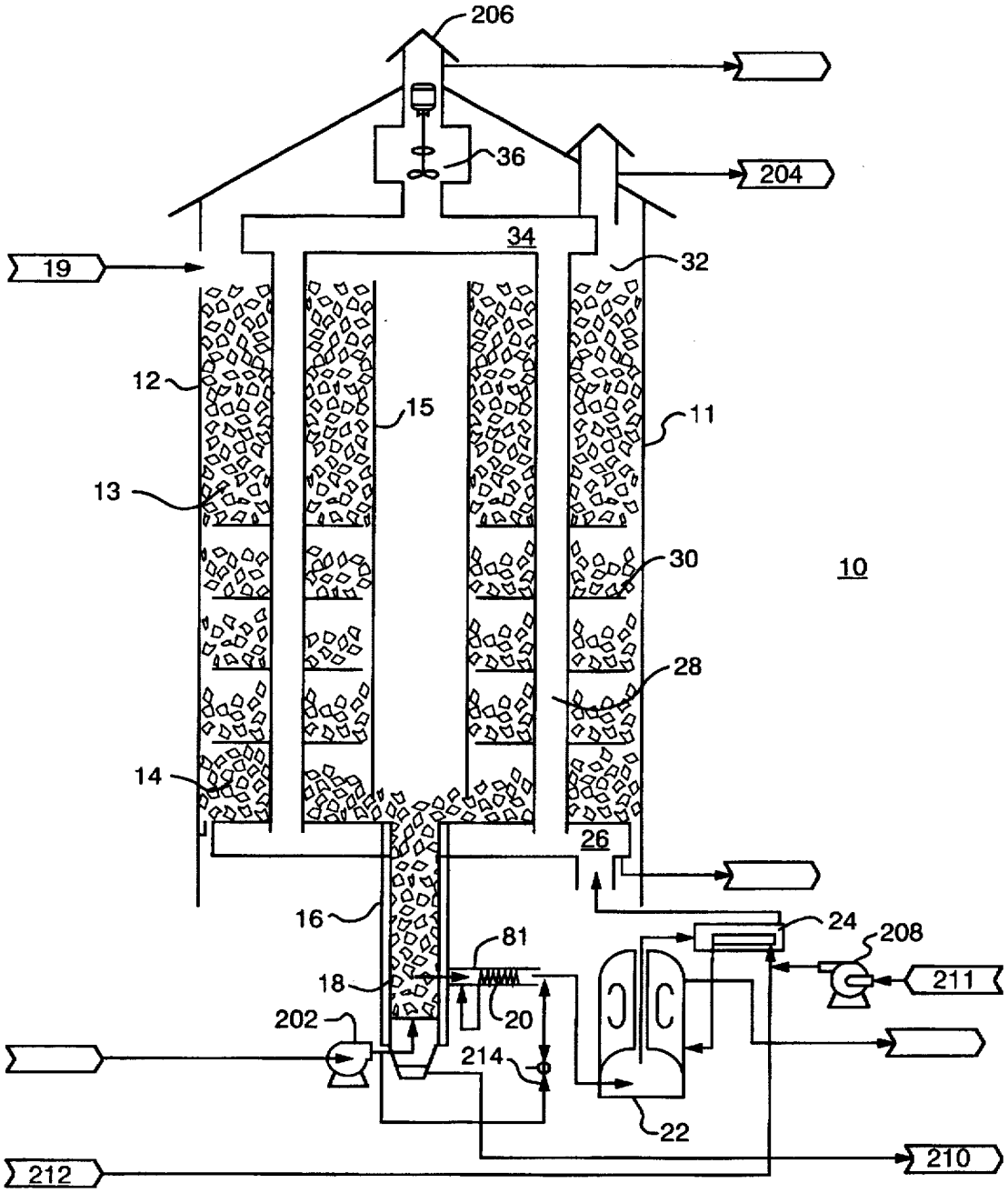
FIG. 1 is a schematic diagram of the biomass-fueled furnace in accordance with the invention.

The invention is designed to be used with any available biomass fuel, however, its embodiment described herein is directed to the use of wood chips. Only minor modifications, well known by those skilled in the art, would be required to use different biomass fuels. The furnace is fed vertically such that the selected biomass fuel burns as a moving bed, acting much like a cigarette pointed downward; the burning end at the bottom. Fuel is added continuously at the top of the bed to feed the primary combustor and prevent heat and/or flames from entering the storage area. Air flowing upward burns and gasifies the fuel to create hot primary pyrolysis gases that are filtered by the fuel bed and then exit through a port in the side of the primary combuster. Secondary air passes through a heat exchanger and then mixes with pyrolysis gases, oxidizing them completely to carbon dioxide and water.

Flue gases are used to heat water and dry fuel until their temperature is near ambient and much of the water from combustion is condensed. This leads to maximum efficiency and a benign exhaust stream.

Handling of wood chips is often plagued by problems such as bridging and jamming in feeders and hoppers. The need for a large turn-down ratio, i.e., "pilot light" capability, and high efficiency (plus the drying of fuel necessary to achieve the turn-down ratio and efficiency) compounds the challenge for space heating applications.

For the average owner, five major problems must be solved for a furnace to satisfy one's expectation of convenience. They can be classified into five major categories; start-up, control, fouling, feeding, and drying.

Theoretically, biomass combustion is as simple or simpler than fuel-oil combustion. This assumes, however, steady state operation. Space and water heating demands usually vary substantially from hour to hour and day to day. In fact, most of the complexity of a typical furnace, whether oil or gas fired, is associated with the start-up and variability of load. Frequent ignition and shut-down is even more complex with a solid fuel. To overcome this obstacle, the inventor has found the "pilot light" approach to be preferable, that is, the combustor is always burning, but, sometimes, at extremely low rates(i.e., "idle" mode). Thus, ignition is necessary only to put the furnace into service at the beginning of operation or after maintenance shut-downs. To burn continuously, a biomass furnace must be able to operate anywhere between 10% and 100% of design capacity with high efficiency. This is defined as the turn-down ratio. The inventor has found that the necessary broad turn-down ratio can be achieved if the biomass fuel, such as wood chips, is dry. (Major cost benefits can only be obtained from using wood chips that are "green or wet". Therefore, an economical and efficient dryer is an important part of the furnace.)

Efficient control of this biomass gasifier demands precise regulation of primary and secondary air flow. Such is easily accomplished with valves in air lines that are supplied by a positive displacement gas mover.

In conventional wood burners, fouling is often caused by fly ash and pyrolysis products. This invention prevents fly-ash entrainment in the first place. Primary pyrolysis gas velocities are kept low, and the fuel itself acts as a filter. High temperatures in the primary combustion zone prevent smoke and other pyrolysis products from condensing until secondary combustion is able to convert them to clean, harmless gases.

The invention features continuous feeding of fuel by gravity with its rate controlled by primary air rate. Problems with bridging and hang-up are legendary in wood chip combustors, but dry chips are proven to flow more easily than wet or green ones. Chip drying and other features of the storage/delivery system described herein circumvent typical chip feeding problems. A heated storage bin also eliminates problems created by frozen wet chips.

Fuel dryness is vital for high efficiency, broad turn-down, clean flue gas and free-flowing chips. Drying operations are common in industry, but the equipment and energy are expensive. In wood chip-fired electric power plants, drying is not done because of the overwhelming capital cost. This is one of the reasons why chip-fired power plants are only about two-thirds as efficient as oil-fired ones. This capital penalty is unfortunate, because there is plenty of low-grade heat available for drying in wood-fired plants.

On the other hand, space heaters rarely operate at peak capacity. Thus, drying is practical. In effect, one buys a furnace to meet the demands of the coldest day. Yet, it stands idle or at reduced load most of the time. If the dryer operates even while the furnace is turned down, it can be smaller and less expensive.

The example presented herein is for a furnace that meets the heating demands of a typical single family dwelling. Smaller or larger heating requirements would necessitate the unit to be scaled accordingly. This furnace is designed to supply 60 joules per second of space and/or water heat. This is equivalent to 200,000 BTU per hour which is adequate to accommodate the maximum demand of a large single-family dwelling. At this rate, 8 grams per second of wood chips would be consumed. Fuel is assumed to enter the unit with 50% moisture which is plus or minus 10% of that typical in forest-run slash.

Preferably, the wood chips are dried to about 30% moisture. At that level, the adiabatic flame temperature falls in the range of 1600° to 1700° C., high enough to assume fast, complete oxidation of organics. Drying to 30% or less moisture is feasible and practical. Not drying at all would suppress flame temperatures to levels where complete oxidation is difficult and pollution a problem. It is difficult to burn wet fuel at low rates, although it is done as a matter of course in large grate-bed commercial units. As depicted in FIG. 1, flue gases, first heat water for the dwelling and, then, flow to the dryer. They leave the dryer at 40° C. In certain circumstances, they might be used further to heat additional home space or preheat domestic water.

The hot water produced at a rate of 350 grams per second by the combustor of FIG. 1 represents an overall efficiency of about 75%. This compares with 50% reported for a large motel-sized unit operated without drying.

As shown in FIG. 1, furnace 10 is shown in its preferred embodiment as a tower-like structure that would be adjacent to the rear of the dwelling (not shown). Due to the volume of wood chips 13 that must be stored, much of the volume of furnace 10 is due to wood chip dryer/storage assembly 11. Outer shell 12 is preferably fabricated from attractive material that will provide the necessary protection of wood chips from the elements. While the shape of outer shell 12 is preferably cylindrical, other shapes could also be used. An architect or craftsperson skilled in the trade could design a shell that is attractive and compatible with the home or structure serviced by the furnace. Construction materials well known in the art are suitable for use. Wood chips 13 are positioned within assembly 11 by inner mesh cylinder 15. Cylinder 15 is preferably an expanded metal mesh or other similar material that allows for maximum air circulation. A similar mesh layer (not shown) holds the wood chips 13 a few centimeters from the outer shell 12 to assist drying the "green/wet" wood chips 13. "Green/wet" wood chips 13 are loaded into the top of assembly 11 through port 19. It is expected that once a market has been established for wood chips as a fuel, vendors will deliver wood chips with a conveyor to elevate them to the top of the chip pile.

Figure 2:
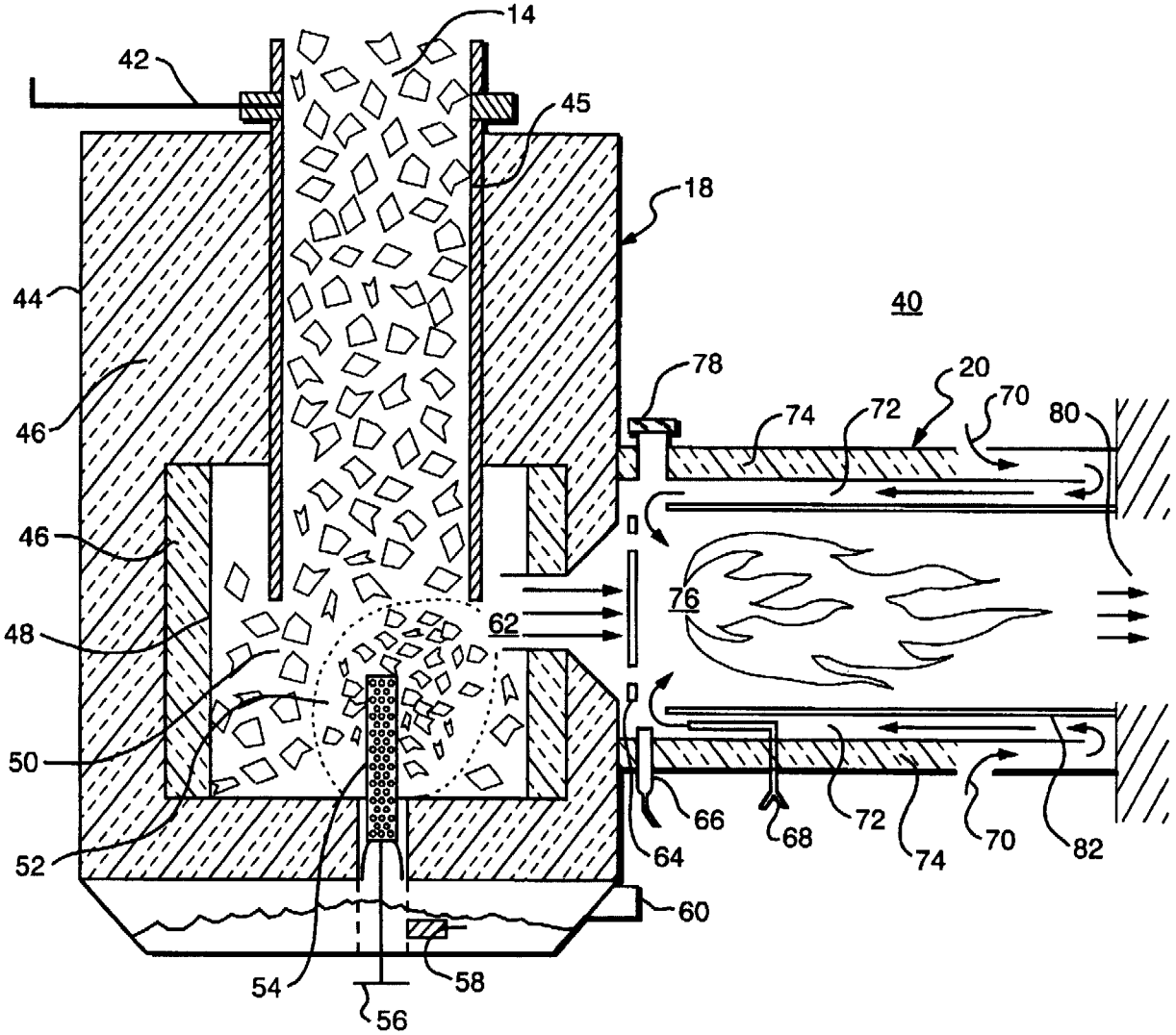
FIG. 2 is a detailed schematic diagram of the burner section of the furnace.

As "green/wet" chips 13 reach the bottom of assembly 11, chips 13 are transformed into dry chips 14. Chips 14 have been partially dried in assembly 11 as will be described below. Once chips 14 reach the bottom, chips 14 are fed via gravity to vertical gravity feed pipe 16. From there, chips 14 are gravity fed to primary combustion chamber 18, the details of which are shown in FIG. 2. Optionally, a mechanical means (not shown) may be used to push chips 14 into the top of feed pipe 16.

Blower 202, preferably a positive-displacement gas mover, forces primary combustion air to primary combustion chamber 18 where wood chips 14 are burned and gasified as discussed above. A sufficient height of chips 14 is maintained above the point of combustion to ensure that there is no danger of combustion gases entering the chip storage area. Gases exit from the side of primary combustion zone 18 to secondary combustion chamber 81. Secondary combustion air is fed through heat exchanger 20 which preheats it prior to entry into the secondary combustion chamber. Valve 214 is used to regulate the flow of secondary combustion air.

Once secondary air is combined with pyrolysis gases, the pyrolysis gases are burned completely to carbon dioxide and water. Unwanted pollutants are avoided by carefully controlling temperatures, stoichiometry and air distribution.

From here, completely oxidized gases enter primary heat exchanger 22. A commercially available 50 gallon unit normally used with an oil burner is acceptable for use as heat exchanger 22. Fresh water 212 is obtained from the domestic supply to the dwelling and enters heat exchanger 22 where it is heated. Water 212 could be first sent to optional secondary heat exchanger coil 24, which will preheat water 212 prior to entering heat exchanger 22. After exiting heat exchanger 22, water 212 is fed to the building's radiators or hot water faucets. Radiator water 211 is returned via circulator pump 208. Pump 208 is typical of the type used with forced hot water, oil or gas fired systems. The hot gas that exits heat exchanger 22 (or optional secondary heat exchanger 24, if used) is, then, ducted to flue gas plenum 26. Flue gas plenum 26 is preferably fabricated from typical sheet metal used for heating systems. Plenum 26 is preferably "doughnut" shaped having an outer diameter of 1.5 m, and an inner diameter of 1.1 m and thickness of 20 cm.

Flue gas plenum 26 feeds into eight flue pipes 28. Flue pipes 28 are preferably fabricated from galvanized corrugated metal culvert piping. As viewed from the top of assembly 11, each pipe 28 would be radially 45 degrees from one another, that is radially symmetrical. The number of flue pipes 28 is not critical, more or less could be used depending on the dimensions of assembly 11. In this example, assembly 11 is preferably about 7 m high, about 2.5 m in diameter, with each flue pipe 28 preferably about 18 cm in diameter. Each flue pipe 28 is reconnected again via plenum 34. Plenum 34 is again preferably "doughnut" shaped having substantially the same dimensions as plenum 26. Flue pipes 28 can be rotated to promote the flow of wood chips 13. Attached to flue pipes 28 are shelf-like trays 30. The warmth and constant agitation ensure that chips 13 are dried. Exiting the top of plenum 34 is roof vent 206. An optional fan 36 can be placed within roof vent 206. Fan 36 has been helpful during start-up but is not essential. Dryer vent 204 serves to vent assembly 11 housing wood chips 13.

A water-filled sealing mechanism (shown in detail in FIG. 3) is employed between flue pipes 28 and plenums 26 and 34. The water sealing system allows free rotation of flue pipes 28 yet provides a gas tight seal. A damper system (not shown) could also be added to flue pipes 28 to further regulate flue exhaust flow.

Referring now to FIG. 2, a detailed schematic diagram of burner section 40 of furnace 10 is shown. Dry chips 14 flow by gravity through gate valve 42. Valve 42 is fully open during normal operation. Valve 42 can be closed to isolate primary combustion chamber 18 from the dryer/storage assembly 11 during shut-down. Primary combustion chamber 18 is preferably cylindrically shaped having an steel outer housing 44. Typical dimensions of chamber 18 approximate the size of a 30 gallon drum. Insulation 46 such as high-temperature resistant mineral wool lines housing 44 having a thickness of at least 5 cm. One could use a less expensive insulation in the outer area, such as fiberglass. Inner liner 48 of primary combustion chamber 18 is preferably from a highly heat resistant material such as a titanium sheet, however, other materials would also be suitable. The preferred thickness is about 0.4 mm.

As illustrated, unburned chips 14 fill the primary combustion region 50. Immediately adjacent thereto, pyrolysis region 52 is where pyrolysis, or gasification of the wood chips 14 takes place. In this region, burning and partially burned chips produce hot flammable gases since the amount of oxygen is insufficient for complete combustion. Air is supplied through primary air inlet 60. Thimble 54 is preferably a perforated stainless steel cylinder with a plurality of openings. The size of the openings is dependent upon the fuel used. The opening must be small enough so that the expected smallest size wood chips will not fit through. The total surface area of the openings must be sufficiently large to accommodate the expected volume of primary air when the furnace is experiencing maximum heat demand. Thimble 54 is essentially a closed surface, thus, radiant heat loss is minimized. Unlike a grate or grid which causes heat to be radiated away from the combustion site, heat from the inside surface of thimble 54 is radiated back to another part of the inside surface of thimble 54 or to neighboring fuel via the openings in this surface. This permits steady, smoldering primary combustion to continue without quenching or dying out at lower primary air rates (idle mode).

In the preferred embodiment, thimble 54 is a cylinder approximately 2.4 cm O.D. and 15.5 cm in length of perforated stainless steel approximately 0.64 mm thick. Thimble 54 is sealed at the top with a solid disk. Perforations are preferably 3 mm in diameter, spaced 4 mm apart on triangular centers.

Handle 56 is attached to thimble 54 and can be rotated in place. This assists the ash to exit the outlet in thimble 54. Handle 56 is preferably rotated by a timer motor with a manual rotation capability in the event of a power failure.

Ash collector 58 serves as a depository for the ash. Once a market has been established for wood chips as a source of fuel for many residential dwellings, ash collection will be part of the services provided by the wood chip vendor.

From the primary combustion chamber 18, pyrolysis gases pass through a quartz glass port 62 that is slipped into a galvanized metal expander, thus yielding a funnel-shaped appearance. Also, metal tube 45 extends below the opening to port 62. This is to prevent chips from entering port 62.

Optionally, pyrolysis gases can be fed through perforated disk 64 as the gases enter second combustion chamber 20. The purpose of perforated disk 64 is to serve as an anchor point for the secondary flame 76. If used, disk 64 should be fabricated from a stainless plate about 23 cm in diameter having sixteen 13 mm openings equally spaced on a 13 cm diameter circle. Another option would be a sliding damper used like a gate valve to reduce the flow area in this location to correspondingly reduce the burning rate.

During start-up of furnace 10, ignitor 66 is used to ignite the pyrolysis gases until the heat is sufficient to keep secondary combustion chamber 20 self-sustaining. Ignitor 66 is preferably a propane torch, however, other systems that provide a flame sufficiently hot to ignite the pyrolysis gases would also suffice.

Thermocouple 68 measures the pre-heat temperature of secondary combustion air which is typically 400° to 600° C. Secondary combustion air is introduced into secondary combustion chamber 20 via secondary combustion inlets 70. Inlets 70 are a series of holes around the circumference of the secondary combustion chamber. Inlets 70 can be opened or closed with a sliding sleeve to regulate the flow.

Secondary air pre-heat zone 72 is where air supplied to secondary flame 76 is heated by transfer through inner wall 82.

Secondary combustion chamber 20 is insulated by insulation layer 74. Insulation layer 74 is preferably the same mineral wool material used for primary combustion chamber 18, preferably 2.0 cm thick.

Once pre-heated secondary combustion air is mixed with the pyrolysis gases and ignited in zone 76, complete combustion occurs resulting in water vapor and carbon dioxide as the end products, thus, a pollution free exhaust. View port 78 enables a user to check for presence of a secondary flame. This port is optional and could be eliminated if desired.

Secondary combustion products, that is, clean hot gases then flow via outlet 80 to primary heat exchanger 22.

Figure 3:
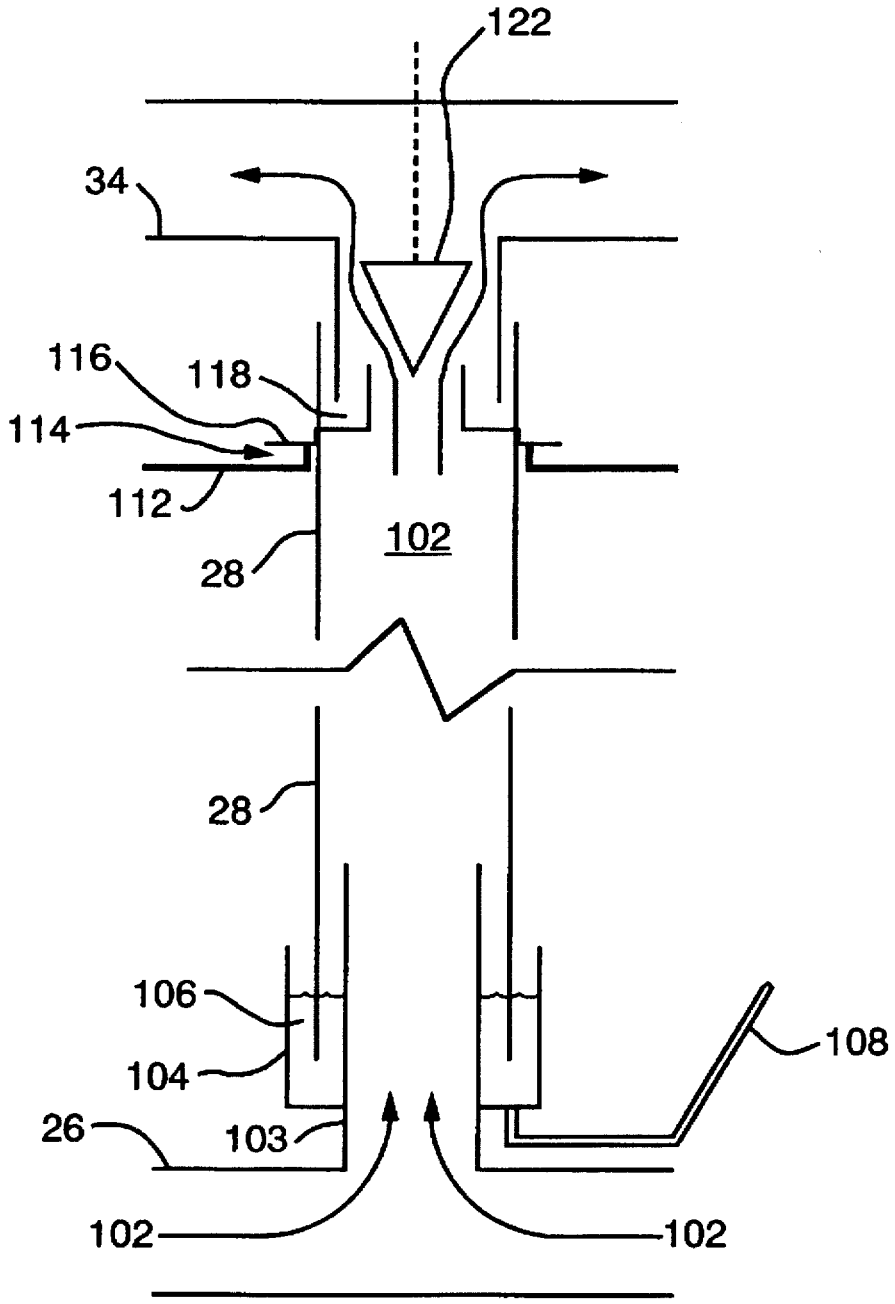
FIG. 3 is a detailed schematic diagram of the drying section of the furnace.

Referring now to FIG. 3, flue pipes 28 and plenums 26, 34 subassembly of wood chip dryer/storage assembly 11 of furnace 10 will be discussed in detail. As noted above, lower plenum 26 receives hot clean gases exiting from the heat exchangers via flow path 102. Each joint between a flue pipe 28 and lower plenum 26 is provided with a gas-tight dynamic seal. Lower water reservoir 104 is attached to outlet 103 on plenum 26. Lower water reservoir 104 is a sheet metal collar that is preferably welded to outlet 103, however, other attachment methods would also be suitable. Lower water reservoir 104 is filled with water to water level 106. Water level 106 is maintained by water from the flue gases condensing on the inner walls of the flue pipe 28 and running down into reservoir 104. Drain line 108 is provided to remove excess condensed water so that water level 106 is not exceeded.

The dimensions of these pads are not critical. Representative choices for the described embodiment are as follows: for a flue pipe having a 20 cm diameter, outlet 103 should be about 12.5 cm, and lower reservoir about 20 cm and 10 cm high which permits water level 106 to be about 7 cm deep.

The weight of each flue pipe 28 is borne by structural support 114 which is a collar bolted to the circumference of pipe 28. Then support 114 rests on ball bearing turntable 112 which permits flue pipe 28 to turn freely. Sprocket 116 is attached to flue pipe 28 which allows a chain drive mechanism for rotating flue pipes 28.

A second water seal is also provided where flue pipes 28 join upper plenum 34. This seal is essentially the same as the lower one except that upper water reservoir 118 is fitted to the inside of flue pipe 28. Water level is maintained by condensation inside the upper plenum 34. Excess water will overflow, run along flue pipe 28 to lower water reservoir 104, and flow out drain 108.

Optional, cone-shaped damper assembly 122 which is preferably suspended by a chain, can be lowered to mate with the rim of the upper water reservoir 118 to reduce or shut down the flow through an individual flue pipe 28.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A biomass-fueled furnace for heating a structure having a heat demand, said furnace comprising:

a two stage combustion section having a primary combustor and a secondary combustor, said secondary combustor having a wall that facilitates heat transfer;

a fuel storage section connected to said primary combustor, with said fuel storage section conveying the fuel to said primary combustor;

a source of air for the primary combustor and a source of air for the secondary combustor; wherein said fuel is converted into pyrolysis gases within said primary combustor and wherein said pyrolysis gases are substantially oxidized to carbon dioxide gas and water vapor within said secondary combustor; and a heat exchanger having an inlet connected to the source of air for the secondary combustor and an outlet connected to said secondary combustor, said heat exchanger associated with and directly in contact with the wall of said secondary combustor, such that a portion of the heat produced into said secondary combustor is transferred through said heat exchanger to pre-heat the air for said secondary combustor.

2. The biomass-fueled furnace of claim 1 further comprising:

a thimble within said primary combustor, said thimble having a three-dimensional substantially closed surface with an outside and an inside, with said surface having a plurality of openings and an outlet, such that the total surface area of said openings corresponds to the flow of air to said primary combustor, and with the size of said openings corresponding to the size of the fuel, wherein the heat from the burning fuel adjacent to said thimble is substantially radiated back to said thimble and neighboring burning fuel.

3. The biomass-fueled furnace of claim 2 further comprising:

blower means, connected to said primary source of air, for providing a positive displacement-type of air flow; and controlling means for controlling said blower means in accordance with the heat demand, such that the rate of fuel being burned in said furnace corresponds to the flow of air to said primary combustor.

4. The biomass-fueled furnace of claim 3 further comprising:

a first flue gas plenum having an inlet connected to said secondary combustor to receive flue gas from said secondary combustor, said plenum having an outlet connected to a plurality of pipes positioned within said fuel storage section and in direct contact with a portion of the fuel, wherein the heat from the flue gas within said pipes assists drying the fuel.

5. A biomass-fueled furnace for heating a structure having a heat demand, said furnace comprising:

a two stage combustion section having a primary combustor and a secondary combustor;

a fuel storage section connected to said primary combustor, with said fuel storage section conveying the fuel to said primary combustor;

a source of air for the primary combustor and a source of air for the secondary combustor; wherein said fuel is converted into pyrolysis gases within said primary combustor and wherein said pyrolysis gases are substantially oxidized to carbon dioxide gas and water vapor within said secondary combustor; and a thimble within said primary combustor, said thimble having a three-dimensional substantially closed surface with an outside and an inside, with said surface having a plurality of openings and an outlet, such that the total surface area of said openings corresponds to the flow of air to said primary combustor, and with the size of said openings corresponding to the size of the fuel, wherein the heat from the burning fuel adjacent to said thimble is substantially radiated back to said thimble and neighboring burning fuel.

6. The biomass-fueled furnace of claim 5 further comprising:

a heat exchanger having an inlet connected to the source of air for the secondary combustor and an outlet connected to said secondary combustor, said heat exchanger associated with said secondary combustor, such that a portion of the heat produced into said secondary combustor is transferred through said heat exchanger to pre-heat the air for secondary combustor.

7. The biomass-fueled furnace of claim 6 further comprising:

blower means, connected to said primary source of air, for providing a positive displacement-type of air flow; and controlling means for controlling said blower means in accordance with the heat demand, such that the rate of fuel being burned in said furnace corresponds to the flow of air to said primary combustor.

8. The biomass-fueled furnace of claim 7 further comprising a first flue gas plenum having an inlet connected to said secondary combustor to receive flue gas from said secondary combustor, said plenum having an outlet connected to a plurality of pipes positioned within said fuel storage section and in direct contact with a portion of the fuel, wherein the heat from the flue gas within said pipes assists drying the fuel.

9. A biomass-fueled furnace for heating a structure having a heat demand, said furnace comprising:

a two stage combustion section having a primary combustor and a secondary combustor;

a fuel storage section connected to said primary combustor, with said fuel storage section conveying the fuel to said primary combustor by gravity;

a source of air for the primary combustor and a source of air for the secondary combustor; wherein said fuel is converted into pyrolysis gases within said primary combustor and wherein said pyrolysis gases are substantially oxidized to carbon dioxide gas and water vapor within said secondary combustor;

blower means, connected to said primary source of air, for providing a positive displacement-type of air flow; and controlling means for controlling said blower means in accordance with the heat demand, such that the rate of fuel being burned in said furnace corresponds to the flow of air to said primary combustor; and a heat exchanger having an inlet connected to the source of air for the secondary combustor and an outlet connected to said secondary combustor, said heat exchanger associated with said secondary combustor, such that a portion of the heat produced into said secondary combustor is transferred through said heat exchanger to pre-heat the air for secondary combustor.

10. The biomass-fueled furnace of claim 9 further comprising:

a thimble within said primary combustor, said thimble having a three-dimensional substantially closed surface with an outside and an inside, with said surface having a plurality of openings and an outlet, such that the total surface area of said openings corresponds to the flow of air to said primary combustor, and with the size of said openings corresponding to the size of the fuel, wherein the heat from the burning fuel adjacent to said thimble is substantially radiated back to said thimble and neighboring burning fuel.

11. The biomass-fueled furnace of claim 10 further comprising:

a first flue gas plenum having an inlet connected to said secondary combustor to receive flue gas from said secondary combustor, said plenum having an outlet connected to a plurality of pipes positioned within said fuel storage section and in direct contact with a portion of the fuel, wherein the heat from the flue gas within said pipes assists drying the fuel.

12. A biomass-fueled furnace for heating a structure having a heat demand, said furnace comprising:

a two stage combustion section having a primary combustor and a secondary combustor;

a fuel storage section connected to said primary combustor, with said fuel storage section conveying the fuel to said primary combustor;

a source of air for the primary combustor and a source of air for the secondary combustor; wherein said fuel is converted into pyrolysis gases within said primary combustor and wherein said pyrolysis gases are substantially oxidized to carbon dioxide gas and water vapor within said secondary combustor; and a first flue gas plenum having an inlet connected to said secondary combustor to receive flue gas from said secondary combustor, said plenum having an outlet connected to a plurality of pipes positioned within said fuel storage section and in direct contact with a portion of the fuel, wherein the heat from the flue gas within said pipes assists drying the fuel.

13. The biomass-fueled furnace of claim 12 further comprising:

a heat exchanger having an inlet connected to the source of air for the secondary combustor and an outlet connected to said secondary combustor, said heat exchanger associated with said secondary combustor, such that a portion of the heat produced into said secondary combustor is transferred through said heat exchanger to pre-heat the air for secondary combustor.

14. The biomass-fueled furnace of claim 13 further comprising:

a thimble within said primary combustor, said thimble having a three-dimensional substantially closed surface with an outside and an inside, with said surface having a plurality of openings and an outlet, such that the total surface area of said openings corresponds to the flow of air to said primary combustor, and with the size of said openings corresponding to the size of the fuel, wherein the heat from the burning fuel adjacent to said thimble is substantially radiated back to said thimble and neighboring burning fuel.

15. The biomass-fueled furnace of claim 14 further comprising:

blower means, connected to said primary source of air, for providing a positive displacement-type of air flow; and controlling means for controlling said blower means in accordance with the heat demand, such that the rate of fuel being burned in said furnace corresponds to the flow of air to said primary combustor.

* * * * *